United States Patent [19]

Johnston et al.

[11] Patent Number: 4,720,656

[45] Date of Patent: Jan. 19, 1988

[54] DISCHARGE LAMP HAVING ENVELOPE SUPPORT SPACER

[75] Inventors: David W. Johnston, Waverly, N.Y.; Charles H. Poirier, Topsfield, Mass.

[73] Assignee: GTE Products Corporation, Danvers, Mass.

[21] Appl. No.: 24,955

[22] Filed: Mar. 12, 1987

[51] Int. Cl.[4] ..... H01J 61/30

[52] U.S. Cl. ..... 313/493; 313/634; 206/418

[58] Field of Search ..... 313/493, 634, 292; 220/2.1 R; 206/418; 215/6, 31, 32

[56] References Cited

U.S. PATENT DOCUMENTS

| | | | |
|---|---|---|---|
| 3,337,035 | 8/1967 | Pennybacker | 206/46 |
| 3,548,241 | 12/1970 | Rasch et al. | 313/178 |
| 3,579,174 | 5/1971 | Gilbert, Jr. | 339/144 |
| 4,217,630 | 8/1980 | Albrecht | 362/217 |
| 4,374,340 | 2/1983 | Bouwknegt et al. | 313/220 |
| 4,426,602 | 1/1984 | Mollet et al. | 315/58 |
| 4,481,442 | 11/1984 | Albrecht et al. | 313/493 |

OTHER PUBLICATIONS

Sylvania Product Information Fl35A.
Sylvania Product Information El43.

*Primary Examiner*—David K. Moore
*Assistant Examiner*—Sandra L. O'Shea
*Attorney, Agent, or Firm*—Carlo S. Bessone

[57] ABSTRACT

An arc discharge lamp having a sealed envelope including at least two longitudinally extending leg members spaced a predetermined distance thereapart and joined together by a transversely extending envelope portion. Support spacer means formed from the envelope (e.g., by blow molding) prevents breakage of the transversely extending envelope portion caused by inward deflection of the leg members. Preferably, the support spacer means includes a plurality of truncated-cone shaped protrusions extending laterally between the leg members.

17 Claims, 7 Drawing Figures

DISCHARGE LAMP HAVING ENVELOPE SUPPORT SPACER

TECHNICAL FIELD

This invention relates to arc discharge lamps and more particularly to a support spacer for lamps having at least two longitudinal extending leg members joined together by a transversely extending envelope portion.

BACKGROUND ART

Compact arc discharge fluorescent lamps are known in which the envelope includes at least two longitudinally extending leg members joined together by a transversely extending envelope portion. Examples of such lamps which are commercially available are the "Twin Tube" and "Double Twin Tube" fluorescent lamps manufactured by GTE Sylvania, Danvers, Mass. Other examples are disclosed in U.S. Pat. No. 4,374,340, which issued to Bouwknegt et al. on Feb. 15, 1983; U.S. Pat. No. 4,426,602, which issued to Mollet et al. on Jan. 17, 1984; and U.S. Pat. No. 4,481,442, which issued to Albrecht et al. on Nov. 6, 1984.

In lamps of the above type, in which a plurality of spaced-apart leg members are employed, breakage of the transversely extending envelope portion may occur as the result of inward deflection of the longitudinally extending leg members caused during handling of the lamp.

In order to eliminate the chance of lamp breakage, it is known in the art to attach a separate brace member between the leg members to prevent the compression of the leg members. A "slip-on" brace member is disclosed in U.S. Pat. No. 3,337,035, which issued to Pennybacker on Aug. 22, 1967. The brace is made from stiff wire and is provided with arcuate loops at each end that are slipped over and compressively grip the legs of a U-shaped envelope. While braces of this type work satisfactorily, the looped portions of the brace may cause the brace to fit two tightly or too loosely on the lamp.

Braces which are formed to interfit with lamp base members are also known in the art. Examples of such braces are disclosed in U.S. Pat. No. 3,548,241, which issued to Rasch et al. on Dec. 15, 1970; U.S. Pat. No. 3,579,174, which issued to Gilbert, Jr. on May 18, 1971; and U.S. Pat. No. 4,217,630, which issued to Albrecht on Aug. 12, 1980. Disadvantages of all of the above braces include the added cost incurred for the additional base components.

BRIEF SUMMARY

It is, therefore, an object of this invention to obviate the disadvantages of the prior art.

It is another object of the invention to provide an improved support spacer means to prevent breakage of a lamp that does not add additional components to the lamp.

It is another object of the invention to provide an improved support spacer means which is relatively simple in design and inexpensive to fabricate.

It is still another object to provide an improved support spacer means which is formed directly from the lamp envelope and can be produced without any additional processing steps.

These objects are accomplished in one aspect of the invention by the provision of an arc discharge lamp comprising a sealed envelope of light transmitting vitreous material having a pair of end portions and including at least two longitudinally extending leg members having a predetermined spacing therebetween. The envelope further includes at least one transversely extending envelope portion for interconnection therebetween. An electrode is located within each of the end portions of the envelope. An ionizable medium is contained within the envelope. Support spacer means being formed from the envelope is located between the longitudinally extending leg members. The support spacer means is sufficient to prevent breakage of the transversely extending envelope portion caused by the inward deflection of the longitudinally extending leg members.

In accordance with further teachings of the present invention, the sealed envelope of the arc discharge lamp comprises four longitudinally extending leg members and three transversely extending envelope portions. In a preferred embodiment, the four longitudinally extending leg members intersect the angles of a square in individual cross-sectional planes. The first and second longitudinally extending leg members are connected at the ends remote from the end portions by a first transversely extending envelope portion. The second and third longitudinally extending leg members are connected at substantially the ends adjacent the end portions by a second transversely extending envelope portion. The third and fourth longitudinally extending leg members are connected at the ends remote from the end portions by a third transversely extending envelope portion. Preferably, the support spacer means is located to prevent breakage of the second transversely extending envelope portion.

In accordance with further aspects of the present invention, the first and fourth longitudinally extending leg members are spaced a predetermined distance thereapart and have a first pair of oppositely disposed surfaces located respectively thereon. Similarly, the second and third longitudinally extending leg members are spaced a predetermined distance thereapart and have a second pair of oppositely disposed surfaces located respectively thereon. In one embodiment, the support spacer means comprises at least one protrusion formed from the envelope and located adjacent the first and third transversely extending envelope portions.

In accordance with still further teachings of the present invention, the support spacer means comprises a first protrusion located between the first and fourth longitudinally extending leg members and projecting laterally from one of the first pair of oppositely disposed surfaces and extending substantially to the other of the surfaces of the first pair of oppositely disposed surfaces. Similarly, a second protrusion is located between the second and third longitudinally extending leg members and projects laterally from one of the second pair of oppositely disposed surfaces and extends substantially to the other of the surfaces of the second pair of oppositely disposed surfaces. Preferably, the first and second protrusions are substantially truncated-cone shaped.

In accordance with still further aspects of the present invention, the support spacer means comprises a first and second pair of abutting protrusions projecting respectively from the first and second pair of oppositely disposed surfaces. In one embodiment, each of the abutting protrusions extends laterally a distance equal to about one-half the respective predetermined distance. Preferably, the first and second pair of abutting protrusions are substantially truncated-cone shaped.

In accordance with still further teachings of the present invention, the arc discharge lamp is a fluorescent lamp wherein a phosphor layer is disposed on the internal surface of the lamp envelope. In one embodiment, the end portions of the envelope are adjacently located. Preferably, the arc discharge lamp further includes a lamp base connected to the end portions of the envelope and containing a starter therewithin.

BEST MODE FOR CARRYING OUT THE INVENTION

For a better understanding of the present invention, together with other and further objects, advantages and capabilities thereof, reference is made to the following disclosure and appended claims taken in conjunction with the above described drawings.

Figure 1:
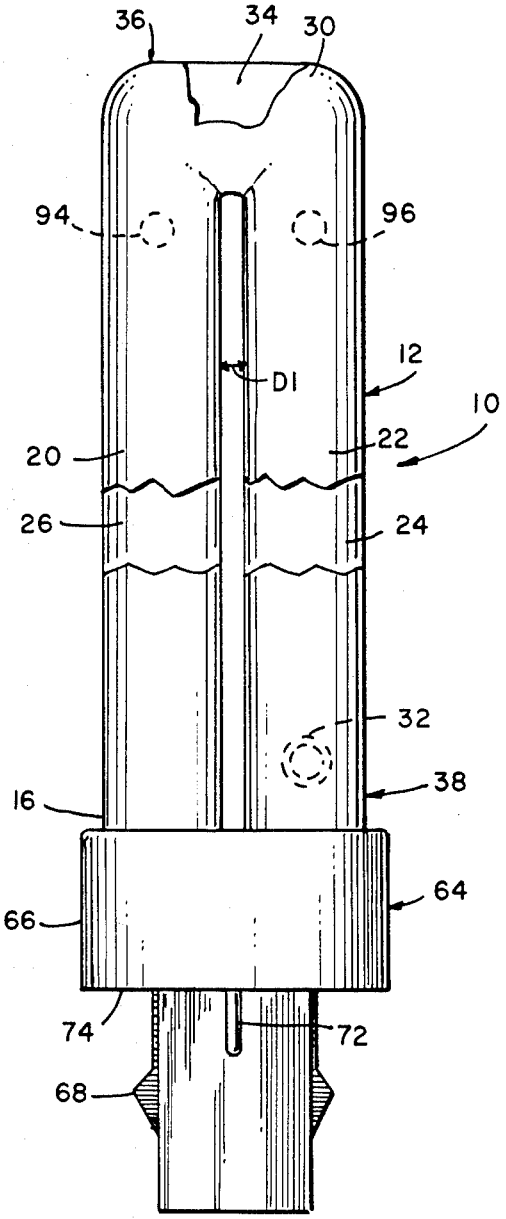
FIG. 1 is a front elevational view, partially broken away, of an embodiment of an arc discharge lamp according to the invention.
Figure 2:
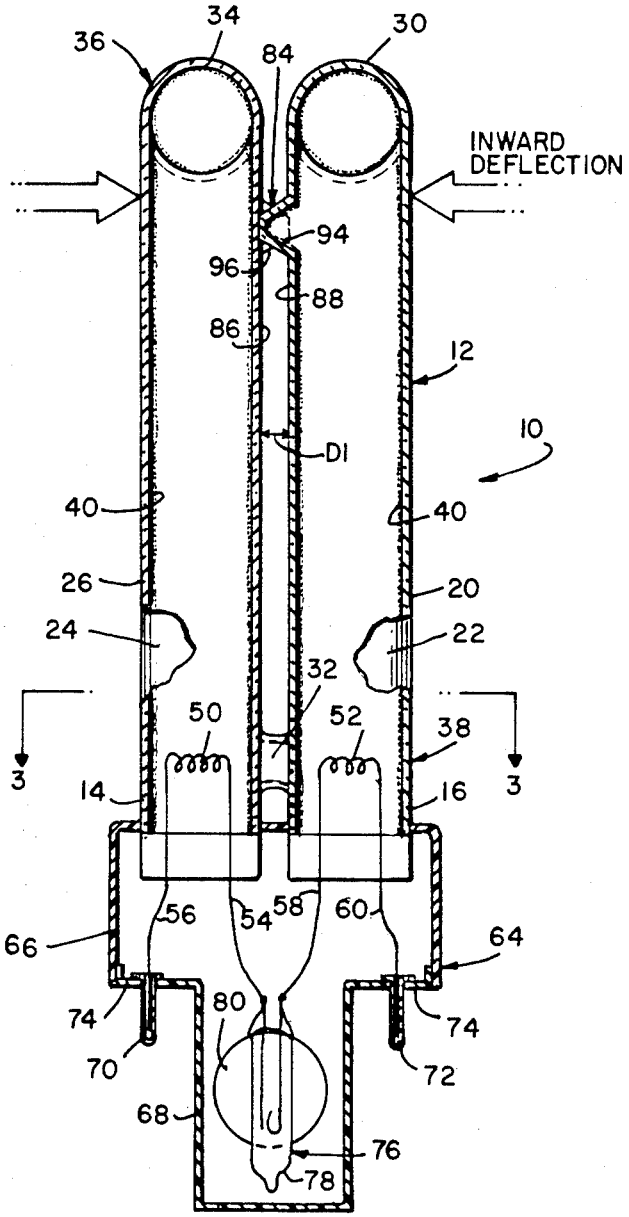
FIG. 2 is a side elevational cross-sectional view of the arc discharge lamp in FIG. 1.
Figure 3:
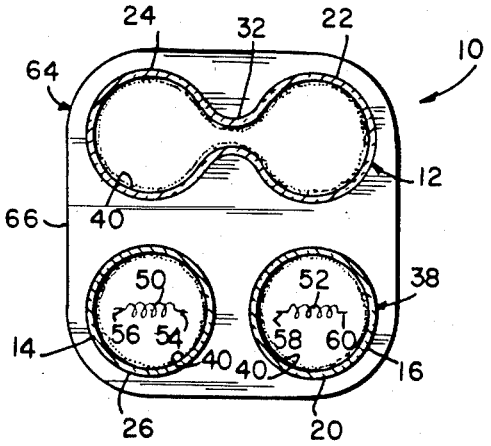
FIG. 3 is a cross-sectional view of the arc discharge lamp taken along the line 3—3 in FIG. 2.

Referring now to the drawings with greater particularity to FIGS. 1–3, there is illustrated an arc discharge lamp 10, such as a fluorescent lamp, including a sealed envelope 12 of light-transmitting vitreous material such as a soda-lime or lead glass and having a pair of end portions 14, 16 and containing an ionizable medium including a quantity of mercury and an inert starting gas at low pressure, for example, in the order of 1–5 mm of mercury. The starting gas can be, for example, argon, krypton, neon, or helium, or a mixture of these and other gases. In the cross-sectional views of lamp 10, as illustrated in FIGS. 2 and 3, an electrode 50, 52 supported by lead-in wires 54, 56 and 58, 60, respectively, is located within a respective end portion 14, 16 of sealed envelope 12. Electrodes 50, 52 can be, for example, a double or triple-coiled tungsten filament of the usual type and carry a coating thereon which is usually in the form of carbonates which upon processing, are converted to oxide. A phosphor layer 40, which converts the ultraviolet radiation generated in the mercury discharge into visible radiation, is disposed on the internal surface of envelope 12.

Envelope 12 of arc discharge lamp 10 includes four longitudinally extending leg members 20, 22, 24, 26 and three transversely extending envelope portions 30, 32, 34. Longitudinally extending leg members 20, 22, 24, 26 are so arranged that they intersect the angles of a square in individual cross-sectional planes. The first leg member 20 and the second leg member 22 are connected at the ends 36 remote from end portions 14, 16 by the first transversely extending envelope portion 30. The second leg member 22 and the third leg member 24 are connected at substantially the ends 38 adjacent end portions 14, 16 by the second transversely extending envelope portion 32. The third leg member 24 and the fourth leg member 26 are connected at ends 36 remote from end portions 14, 16 by the third transversely extending envelope portion 34. The transversely extending envelope portions may have various other shapes, for example, a more rounded U-shape than depicted by envelope portions 30, 34. Also, the transversely extending envelope portions joining a plurality of legs members may all have the same general shape.

Each of the leg members are spaced a predetermined distance D1 apart from an adjacent leg member. The distances between adjacent leg members may be equal or may vary. As best shown in FIGS. 2 and 3, lamp end portions 14, 16 may be adjacently located and may be connected to a suitable lamp base 64 including a generally square-shaped upper portion 66 and a lower portion 68. Illustrated in FIG. 2 is a conventional starter 76 including a glow bottle 78 and a radio frequency suppressing capacitor 80 is located within lower portion 68 of lamp base 64 and is electrically connected to lead-in wires 54 and 58. A pair of electrical contacts 70, 72 project from a surface 74 of lamp base 64 and are electrically connected to lead-in wires 56, 60 respectively.

In accordance to the teachings of the present invention, support spacer means 84 is formed from envelope 12 of lamp 10 and is located between at least two of the longitudinally extending leg members. Support spacer means 84 is sufficient to prevent breakage of at least one of the transversely extending envelope portions caused by the inward deflection (as shown in FIG. 2) of the two longitudinally extending leg members. In a first embodiment shown in FIGS. 1, 2 and 4, at least one protrusion 94 or 96 is formed from envelope 12 at a location adjacent first and third transversely extending envelope portions 30, 34. It is understood that being located adjacent first and third transversely extending envelope portions means that support spacer means 84 can be formed directly in the first and third transversely extending members as best illustrated in FIGS. 1 and 2 or in the longitudinally extending leg members. A first protrusion 94, located between first and fourth longitudinally extending leg members 20, 26, projects laterally from a first surface 88 disposed on first longitudinally extending leg member 20. First protrusion 94 extends substantially to a second surface 86 on fourth longitudinally extending leg member 26 disposed opposite first surface 88. Preferably, the extended end of first protrusion 94 contacts second surface 86. A second protrusion 96, located between second and third longitudinally extending leg members 22, 24, projects laterally from a third surface 92 disposed on third longitudinally extending leg member 24. Second protrusion 96 extends substantially to a fourth surface 90 on second longitudinally extending leg member 22 disposed opposite third surface 92. Preferably, the extended end of second protrusion 96 contacts fourth surface 90. Alternatively, second protrusion 96 can project laterally from fourth surface 90 and extend laterally to contact third surface 92. Protrusions 94, 96 are sufficient to prevent breakage of second transversely extending envelope portion 32 caused by inward deflection of longitudinally extending leg members 20, 22, 24, 26. Preferably, protrusions 94, 96 are substantially truncated-cone shaped.

The protrusions can be blow molded into the lamp envelope during the conventional blow molding operation used to form the transversely extending envelope portion. In this process, only a modification to the existing mold is required.

EXAMPLE I

Figure 4:
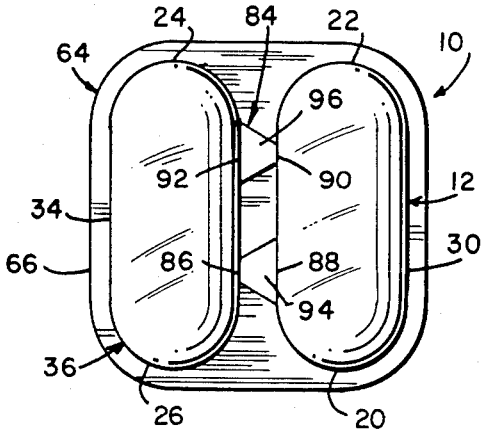
FIG. 4 is a plan view of the arc discharge lamp in FIG. 2.

In a practical example of the above-described embodiment of the invention, the lamp is an F9DTT lamp having four longitudinally extending leg members and three transversely extending envelope portions. The overall length of the lamp is approximately 4.12 inches (104.6 millimeters). The internal surface of the lamp envelope is coated with a layer of 2700K phosphor. The lamp has a G23D base which contains a glow bottle and a radio frequency suppressing capacitor. Each of the leg members is spaced a distance of approximately 0.062 inch (1.57 millimeters) from an adjacent leg member. Two protrusions, as shown in FIGS. 2 and 4, are blow molded into the lamp envelope during the conventional blow molding operation to form the two transversely extending envelope portions located at the ends remote from the electrodes. Each of the protrusions are truncated-cone shaped having a maximum diameter of 0.172 inch (4.37 millimeters), a minimum diameter of 0.100 inch (2.54 millimeters). and a height of 0.062 inch (1.57 millimeters). Each of the protrusions is spaced 0.500 inch (12.7 millimeters) from the top of the lamp.

Figure 5:
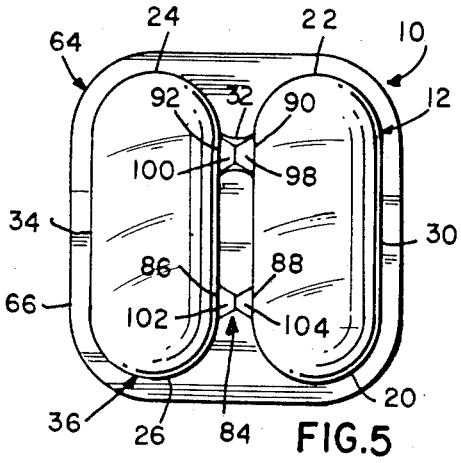
FIG. 5 is a plan view of another embodiment of an arc discharge lamp according to the invention.
Figure 6:
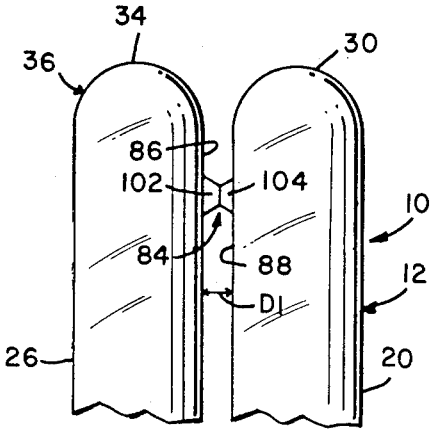
FIG. 6 is a partial side elevational view of the embodiment of the arc discharge lamp shown in FIG. 5.
Figure 7:
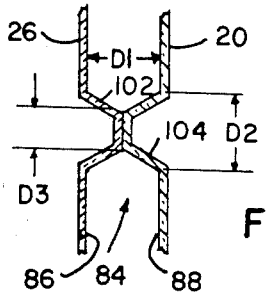
FIG. 7 is a partially enlarged cross-sectional view of the embodiment of the arc discharge lamps shown in FIGS. 5 and 6.

In a second embodiment shown in FIGS. 5–7, support spacer means 84 comprises two pairs 98, 100 and 102, 104 of abutting protrusions Protrusion 98, located between second and third longitudinally extending leg members 22, 24 projects laterally from fourth surface 90 on second longitudinally extending leg member 22 to abut protrusion 100 which projects laterally from third surface 92 on third longitudinally extending leg member 24. Preferably, a second pair 102, 104 of abutting protrusions is located between first and fourth longitudinally extending leg members 20, 26. Protrusion 102 projects laterally from second surface 86 on fourth longitudinally extending leg member 26 to abut protrusion 104 which projects laterally from first surface 88 on first longitudinally extending leg member 20. Protrusions 98, 100, 102, 104 are sufficient to prevent breakage of second transversely extending envelope portion 32 caused by inward deflection of longitudinally extending leg members 20, 22, 24, 26. Preferably, protrusions 98, 100, 102, 104 are substantially truncated-cone shaped.

EXAMPLE II

In a practical example of the above-described embodiment of the invention, the lamp is an F13DTT lamp having four longitudinally extending leg members and three transversely extending envelope portions. The overall length of the lamp is approximately 4.62 inches (117.3 millimeters). The internal surface of the lamp envelope is coated with a layer of 2700K phosphor. The lamp has a G23D base which contains a glow bottle and a radio frequency suppressing capacitor. Each of the leg members is spaced a distance of approximately 0.062 inch (1.57 millimeters) from an adjacent leg member. Two pairs of protrusions, as shown in FIGS. 5–7, are blow molded into the lamp envelope during the conventional blow molding operation to form the two transversely extending envelope portions located at the ends remote from the electrodes. Each of the protrusions are truncated-cone shaped having a maximum diameter D2 (as shown in FIG. 7) of 0.125 inch (3.18 millimeters), a minimum diameter D3 of 0.065 inch (1.65 millimeters), and a height of 0.030 inch (0.762 millimeter) which is approximately equal to one-half the leg member spacing D1. Each of the protrusions is spaced 0.500 inch (12.7 millimeters) from the top of the lamp.

There has thus been shown and described an improved support spacer for an arc discharge lamp having an envelope which includes at least two longitudinally extending leg members spaced a predetermined distance thereapart and joined together by a transversely extending envelope portion. The support spacer means shown and described is relatively simple in design and inexpensive to fabricate. Furthermore, the support spacer means of the present invention is formed directly from the lamp envelope, and does not add additional components or costs associated therewith.

While there have been shown and described what are at present considered to be the preferred embodiments of the invention, it will be apparent to those skilled in the art that various changes and modifications can be made herein without departing from the scope of the invention. For example, a variety of shapes, sizes and locations for the protrusions can be used. The embodiment shown in the drawings and described in the specification are intended to best explain the principles of the invention and its practical application to hereby enable others in the art to best utilize the invention in various embodiments and with various modifications as are suited to the particular use contemplated.

What is claimed is:

1. An arc discharge lamp comprising:

a sealed envelope of light-transmitting vitreous material having a pair of end portions and including at least two longitudinally extending leg members spaced a predetermined distance thereapart and at least one transversely extending envelope portion for interconnection therebetween;

an electrode located within each of said end portions;

an ionizable medium contained within said envelope; and support spacer means formed from said envelope and being located between said longitudinally extending leg members, said support spacer means being sufficient to prevent breakage of said transversely extending envelope portion caused by the inward deflection of said longitudinally extending leg members.

2. The arc discharge lamp of claim 1 wherein said sealed envelope comprises four of said longitudinally extending leg members and three of said transversely extending envelope portions.

3. The arc discharge lamp of claim 2 wherein said four longitudinally extending leg members intersect the angles of a square in individual cross-sectional planes, the first and the second of said longitudinally extending leg members being connected at the ends remote from said end portions by the first of said transversely extending envelope portions, the second and the third of said longitudinally extending leg members being connected at substantially the ends adjacent said end portions by the second of said transversely extending envelope portions, and the third and fourth of said longitudinally extending leg members being connected at the ends remote from said end portions by the third of said transversely extending envelope portions.

4. The arc discharge lamp of claim 3 wherein said support spacer means is located to prevent breakage of said second of said transversely extending envelope portions.

5. The arc discharge lamp of claim 3 wherein said first and fourth longitudinally extending leg members are spaced a predetermined distance thereapart and have a first pair of oppositely disposed surfaces located respectively thereon, and said second and third longitudinally extending leg members are spaced a predetermined distance thereapart and have a second pair of oppositely disposed surfaces located respectively thereon.

6. The arc discharge lamp of claim 5 wherein said support spacer means comprises at least one protrusion formed from said envelope and being located adjacent said first and third transversely extending envelope portions.

7. The arc discharge lamp of claim 5 wherein said support spacer means comprises a first protrusion located between said first and fourth longitudinally extending leg members and a second protrusion located between said second and third longitudinally extending leg members.

8. The arc discharge lamp of claim 7 wherein said first protrusion projects laterally from one of said first pair of oppositely disposed surfaces and extends substantially to the other of said surfaces of said first pair of oppositely disposed surfaces, said second protrusion projecting laterally from one of said second pair of oppositely disposed surfaces and extending substantially to the other of said surfaces of said second pair of oppositely disposed surfaces.

9. The arc discharge lamp of claim 8 wherein said first and second protrusions are substantially truncated-cone shaped.

10. The arc discharge lamp of claim 5 wherein said support spacer means comprises a first and second pair of abutting protrusions projecting respectively from said first and second pair of oppositely disposed surfaces.

11. The arc discharge lamp of claim 10 wherein each of said protrusions extends laterally a distance equal to about one-half said respective predetermined distance.

12. The arc discharge lamp of claim 11 wherein said first and second pair of abutting protrusions are substantially truncated-cone shaped.

13. The arc discharge lamp of claim 1 wherein said lamp is a fluorescent lamp.

14. The arc discharge lamp of claim 1 wherein a phosphor layer is disposed on the internal surface of said envelope.

15. The arc discharge lamp of claim 1 wherein said end portions of said envelope are adjacently located.

16. The arc discharge lamp of claim 1 wherein said arc discharge lamp further includes a lamp base connected to said end portions of said envelope.

17. The arc discharge lamp of claim 16 wherein a starter is included within said base.

* * * * *